US008137056B2

(12) United States Patent
Fujimoto et al.

(10) Patent No.: US 8,137,056 B2
(45) Date of Patent: Mar. 20, 2012

(54) IMPINGEMENT COOLED STRUCTURE

(75) Inventors: Shu Fujimoto, Tokyo (JP); Youji Ohkita, Tokyo (JP); Yoshitaka Fukuyama, Tokyo (JP); Takashi Yamane, Tokyo (JP); Masahiro Matsushita, Tokyo (JP); Toyoaki Yoshida, Tokyo (JP)

(73) Assignees: IHI Corporation, Tokyo (JP); Japan Aerospace Exploration Agency, Tokyo (JP)

( * ) Notice: Subject to any disclaimer, the term of this patent is extended or adjusted under 35 U.S.C. 154(b) by 783 days.

(21) Appl. No.: 12/281,369

(22) PCT Filed: Feb. 26, 2007

(86) PCT No.: PCT/JP2007/053486
§ 371 (c)(1),
(2), (4) Date: Sep. 2, 2008

(87) PCT Pub. No.: WO2007/099895
PCT Pub. Date: Sep. 7, 2007

(65) Prior Publication Data

US 2009/0035125 A1 Feb. 5, 2009

(30) Foreign Application Priority Data

Mar. 2, 2006 (JP) ..... 2006-056084

(51) Int. Cl.
*F04D 31/00* (2006.01)

(52) U.S. Cl. ..... 415/116; 415/175; 415/173.2; 415/173.1

(58) Field of Classification Search ..... 415/116, 415/173.1, 173.2, 175
See application file for complete search history.

(56) References Cited

U.S. PATENT DOCUMENTS 4,526,226 A 7/1985 Hsia et al.
6,146,091 A * 11/2000 Watanabe et al. ..... 415/115
6,779,597 B2 8/2004 DeMarche et al.

FOREIGN PATENT DOCUMENTS

JP 58-65901 4/1983
JP 10-508077 8/1998

(Continued)

OTHER PUBLICATIONS

Microfilm of the specification and drawings annexed to the request of Japanese Utility Model Application No. 60322/1976 (laid open No. 147805/1976), (B.B.C. AG. Brown, Boveri & Cie.), Nov. 27, 1976.
International Search Report issued in corresponding application No. PCT/JP2007/053486, completed Apr. 18, 2007 and mailed May 1, 2007.

(Continued)

*Primary Examiner* — Thao Le
*Assistant Examiner* — Geoffrey Ida
(74) *Attorney, Agent, or Firm* — Griffin & Szipl, P.C.

(57) ABSTRACT

An impingement cooled structure includes a plurality of shroud members disposed in a circumferential direction to constitute a ring-shaped shroud surrounding a hot gas stream, and a shroud cover mounted on radial outside faces of the shroud members to form a cavity therebetween. The shroud cover has a first impingement cooling hole which communicates with the cavity and allows cooling air to be jetted to an inside thereof so as to cool an inner surface of the cavity by impingement. The shroud members each has a hole fin. The hole fin divides the cavity into a plurality of sub-cavities. Further, the hole fin has a second impingement cooling hole which allows the cooling air having flowed through the first impingement cooling hole to be jetted obliquely toward a bottom surface of the sub-cavity adjacent thereto.

8 Claims, 11 Drawing Sheets

FOREIGN PATENT DOCUMENTS

| | | |
|---|---|---|
| JP | 11-200805 | 7/1999 |
| JP | 11-247621 | 9/1999 |
| JP | 11-257003 | 9/1999 |
| JP | 2004-100682 | 4/2004 |
| WO | 96/13653 | 5/1996 |

OTHER PUBLICATIONS

English translation of Rejection Notice issued on Jun. 16, 2011 in corresponding Japanese application.

* cited by examiner

IMPINGEMENT COOLED STRUCTURE

This is a National Phase Application in the United States of International Patent Application No. PCT/JP2007/053486 filed Feb. 26, 2007, which claims priority on Japanese Patent Application No. 056084/2006, filed Mar. 2, 2006. The entire disclosures of the above patent applications are hereby incorporated by reference.

BACKGROUND OF THE INVENTION

1. Technical Field of the Invention

The present invention relates to an impingement cooled structure that cools hot walls of a turbine shroud and a turbine end wall.

2. Description of the Related Art

In recent years, in order to improve thermal efficiency, an increase in the temperature of a gas turbine has been promoted. In this case, the turbine inlet temperature reaches about 1200° C. to 1700° C. Under such high temperatures, metal turbine components need to be cooled so as not to exceed the service temperature limit of the materials thereof.

An example of such turbine components includes a turbine shroud 31 shown in FIG. 1. As shown in a cross-sectional view of FIG. 2, a plurality of turbine shrouds 31 are connected to each other in a circumferential direction to form a ring shape and surround fast-rotating turbine blades 32 such that the ring shape is spaced from the tip surfaces of the turbine blades 32. With this structure, the turbine shrouds 31 have a function of controlling the flow rate of hot gas flowing through a gap between the shrouds 31 and the blades 32.

Hence, the inner surfaces of the turbine shrouds 31 are always exposed to hot gas. Likewise, the inner surface of a turbine end wall is also exposed to hot gas.

In FIG. 2, the reference numeral 33 indicates a fixing portion, such as an inner surface of an engine, which allows the turbine shrouds 31 to be fixed thereto. The reference numeral 34 indicates fixing hardware.

In order to cool hot walls of the aforementioned turbine shrouds and turbine end wall, for example, as shown in FIGS. 3A and 3B, a conventionally employed cooled structure has impingement cooling holes 35, turbulence promoters 36 (or a smoothing flow path with fins), film cooling holes 37, or combination thereof.

However, cooling air used in such a cooled structure is usually high pressure air compressed by a compressor. Accordingly, there is a problem that the amount of the used cooling air directly affects engine performance.

In view of this, in order to reduce the amount of used cooling air, there is proposed a configuration in which cooling air which is once used for impingement cooling is used again for impingement cooling (e.g., Patent Documents 1 and 2).

[Patent Document 1]

Specification of U.S. Pat. No. 4,526,226, "MULTIPLE-IMPINGEMENT COOLED STRUCTURE"

[Patent Document 2]

Specification of U.S. Pat. No. 6,779,597, "MULTIPLE IMPINGEMENT COOLED STRUCTURE"

As shown in FIG. 4, an impingement cooled structure of Patent Document 1 includes: a shroud 47 having an inner surface 38, an outer surface 40, edges 42 and 44, and a rib 46; flanges 48 and 50; a first baffle 56; a second baffle 58; and fluid communication means. An upstream side of the outer surface 40 of the shroud 47 is cooled by impingement by means of cooling air which flows in the through holes of the first baffle 56. Furthermore, the same cooling air flows in the through holes of the second baffle 58 so as to cool the downstream side of the outer surface 40 of the shroud 47 by impingement.

As shown in FIG. 5, an impingement cooled structure of Patent Document 2 includes: a base 62 having an inner surface 64 and an outer surface 66; a first baffle 70; a cavity 72; and a second baffle 74. A downstream side of the outer surface 66 of the base 62 is cooled by impingement by means of cooling air which flows in the through holes of the first baffle 70. Furthermore, the same cooling air flows in the through holes of the second baffle 74 so as to cool the upstream side of the outer surface of the base 62 by impingement.

The impingement cooled structures of Patent Documents 1 and 2, however, need to have a plurality of air chambers (cavities) which are stacked in the radial outward direction on top of each other, and thus, have a problem of an overall thickness greater than that of conventional shrouds. In addition, these impingement cooled structures are complex as compared with shrouds prior to Patent Documents 1 and 2, causing a problem of an increase in manufacturing cost.

SUMMARY OF THE INVENTION

In order to solve the above problems, the present invention was made. Specifically, an object of the present invention is, therefore, to provide an impingement cooled structure capable of reducing the amount of cooling air which cools hot walls of a turbine shroud and a turbine end wall, with a structure as simple as a structure of shrouds prior to Patent Documents 1 and 2.

According to the present invention, there is provided an impingement cooled structure comprising: a plurality of shroud members disposed in a circumferential direction to constitute a ring-shaped shroud surrounding a hot gas stream; and a shroud cover mounted on radial outside faces of the shroud members to form a cavity therebetween. The shroud cover has a first impingement cooling hole which communicates with the cavity and allows cooling air to be jetted to an inside thereof so as to cool an inner surface of the cavity by impingement. The shroud members each has a hole fin. The hole fin divides the cavity into a plurality of sub-cavities. Further, the hole fin has a second impingement cooling hole which allows the cooling air having flowed through the first impingement cooling hole to be jetted obliquely toward a bottom surface of the sub-cavity adjacent thereto.

Preferably, the shroud members each has: an inner surface extending along the hot gas stream to be directly exposed to the hot gas stream; an outer surface positioned at an outside of the inner surface to constitute a bottom surface of the cavity; an upstream flange extending in a radial outward direction from an upstream side of the hot gas stream to be fixed to a fixing portion; and a downstream flange extending in a radial outward direction from a downstream side of the hot gas stream to be fixed to the fixing portion. The upstream flange and the downstream flange are provided for forming a cooling air chamber outside the shroud cover. The hole fin extends in a radial outward direction to an inner surface of the shroud cover from the outer surface constituting the bottom surface of the cavity to divide the cavity into the plurality of sub-cavities adjacent to each other along the hot gas stream.

The upstream flange and/or the downstream flange may have a third impingement cooling hole which allows the cooling air to be jetted toward an outer surface of the flange from the cavity.

The shroud members each may have a film cooling hole which allows the cooling air to be jetted toward the inner surface of the shroud member from the cavity.

The impingement cooled structure may comprise a turbulence promoter, a projection or a pin on the bottom surface of the cavity. The turbulence promoter promotes turbulence, and the projection or the pin increases a heat transfer area.

The shroud members each may have a non-hole fin which divides the cavity into a plurality of sub-cavities and divides a flow path of the cooling air into two or more flow paths.

A gap may be formed between a radial outward end of the hole fin and the inner surface of the shroud cover such that a height Δh of the gap is 0.2 or less times as high as a height h of the hole fin.

Preferably, an angle of the second impingement cooling hole to a bottom surface of a sub-cavity is 45° or less, and an impingement height e is 0.26 or less times as long as a length L of the sub-cavity in a flow path direction.

According to the aforementioned configuration of the present invention, the shroud cover has the first impingement cooling hole which allows cooling air to be jetted in the cavity formed between the shroud cover and shroud members, to cool the inner surface of the cavity by impingement. The shroud members each have the hole fin which divides the cavity into a plurality of the sub-cavities, and the hole fin has the second impingement cooling hole which allows the cooling air having flowed through the first impingement cooling hole to be jetted obliquely toward the bottom surface of the adjacent sub-cavity. Therefore, it is possible to reduce the amount of cooling air for cooling hot walls of a turbine shroud and a turbine end wall, with the thickness of the shroud members being the same as that of conventional ones, without increasing radial thickness of the entire shroud, by the structure simply having the hole fins that is as simple as a conventional structure.

That is, the cooled structure of the present invention is capable of significantly reducing the amount of cooling air by allowing cooling air, which is once used for impingement cooling to hot wall surfaces of the turbine shroud and end wall, to flow through an oblique hole (second impingement cooling hole) provided in the hole fin to re-use the cooling air for impingement cooling.

Other objects and advantageous features of the present invention will become more apparent from the following description made with reference to the accompanying drawings.

DESCRIPTION OF THE PREFERRED EMBODIMENTS

Figure 1:
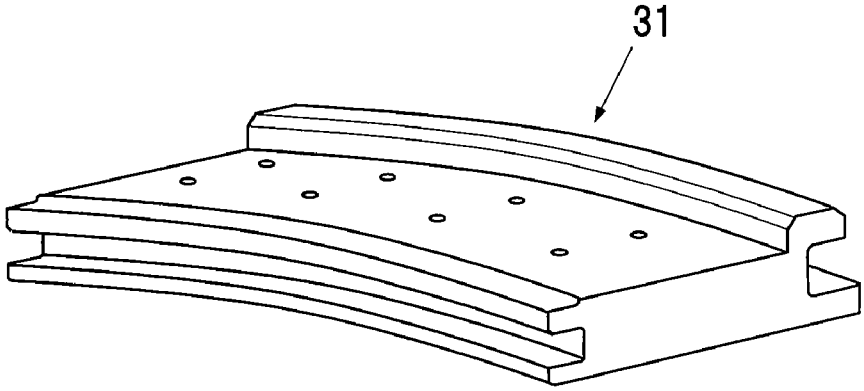
FIG. 1 PRIOR ART
FIG. 1 is a perspective view of a conventional turbine shroud.
Figure 2:
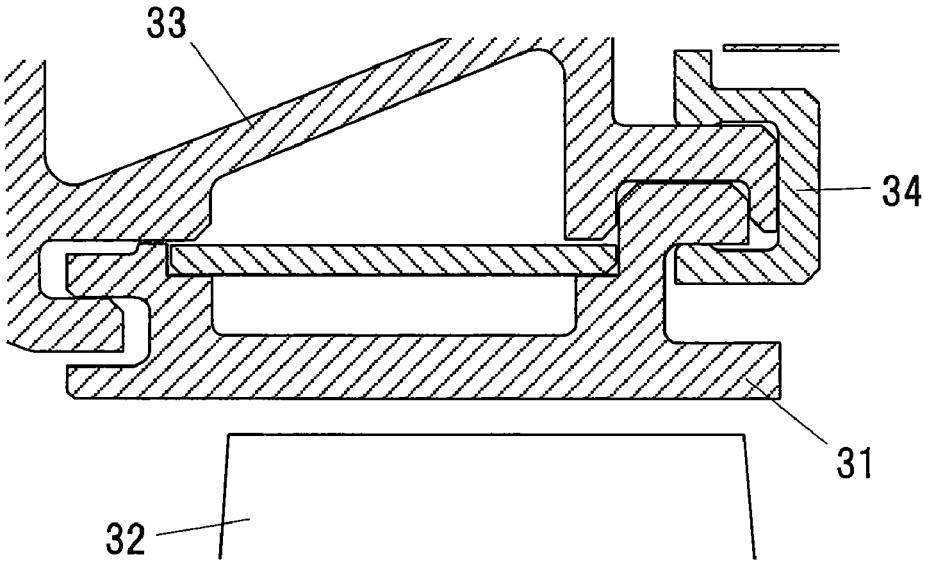
FIG. 2 PRIOR ART
FIG. 2 is a cross-sectional view of the conventional turbine shroud.
Figure 3A:
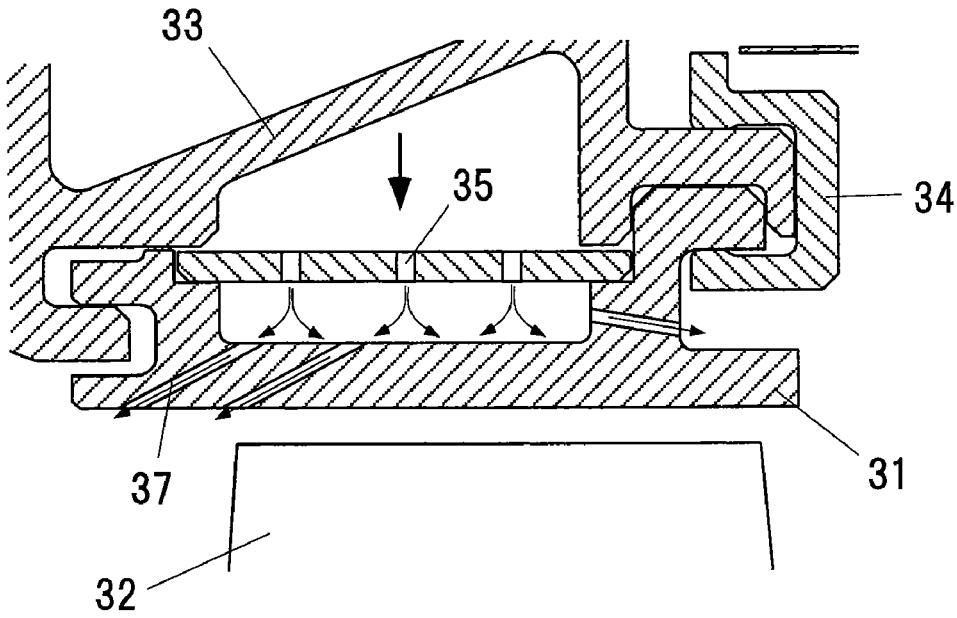
FIG. 3A PRIOR ART
FIG. 3A is a cross-sectional view of a conventional cooled structure.
Figure 3B:
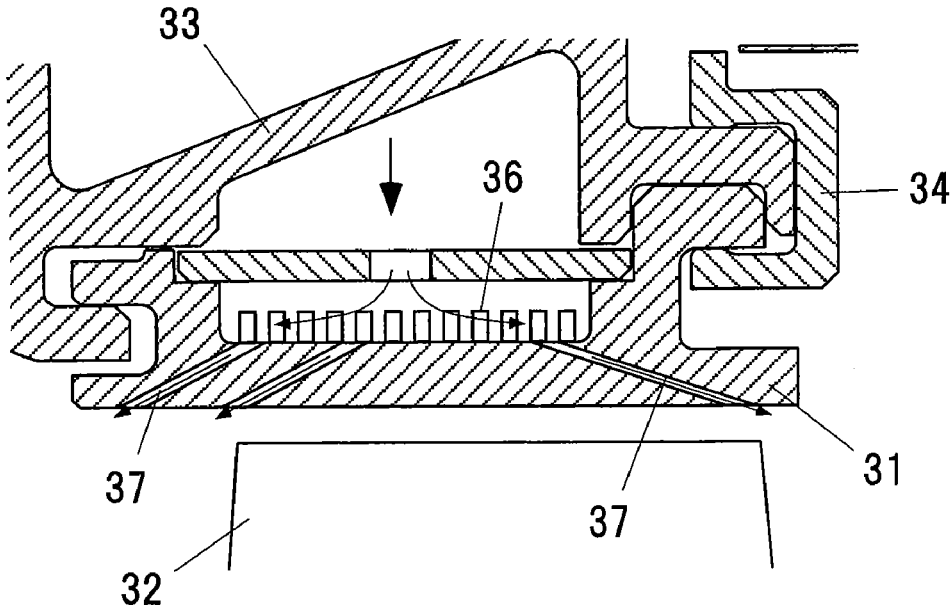
FIG. 3B PRIOR ART
FIG. 3B is a cross-sectional view of another conventional cooled structure.
Figure 4:
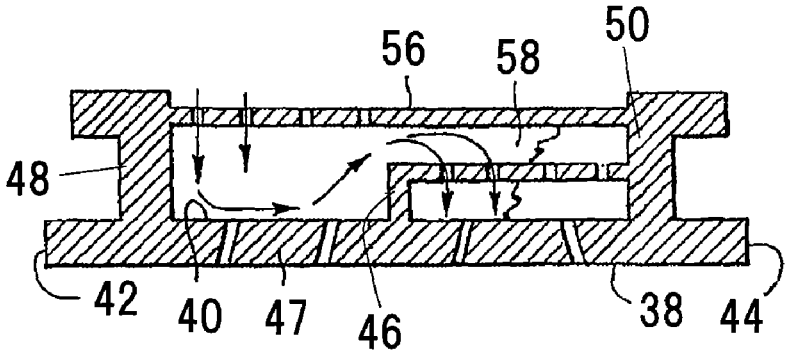
FIG. 4 PRIOR ART
FIG. 4 is a cross-sectional view of an impingement cooled structure of Patent Document 1.
Figure 5:
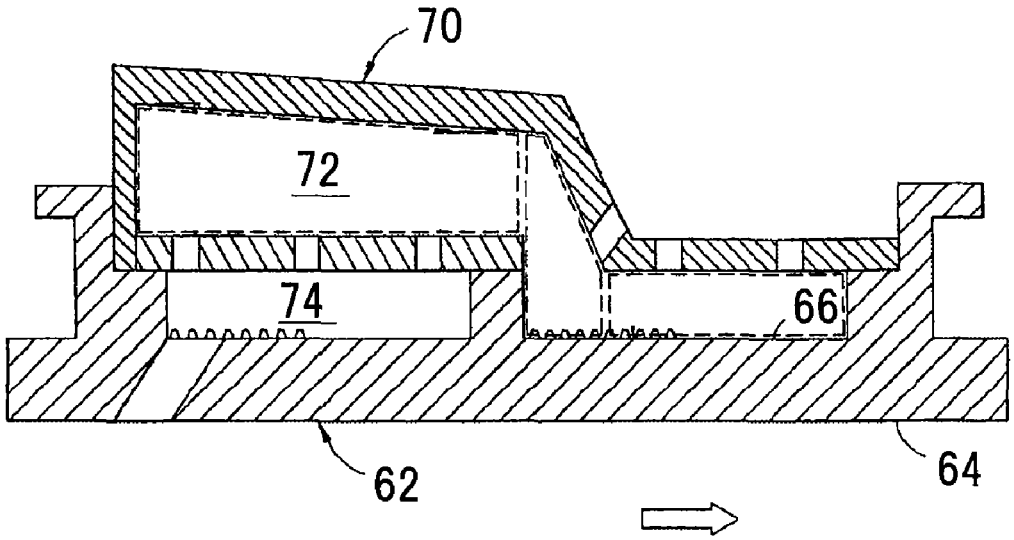
FIG. 5 PRIOR ART
FIG. 5 is a cross-sectional view of an impingement cooled structure of Patent Document 2.

Preferred embodiments of the present invention will be described below with reference to the drawings. In the drawings, common parts are indicated by the same reference numerals, and overlapping description is omitted.

Figure 6:
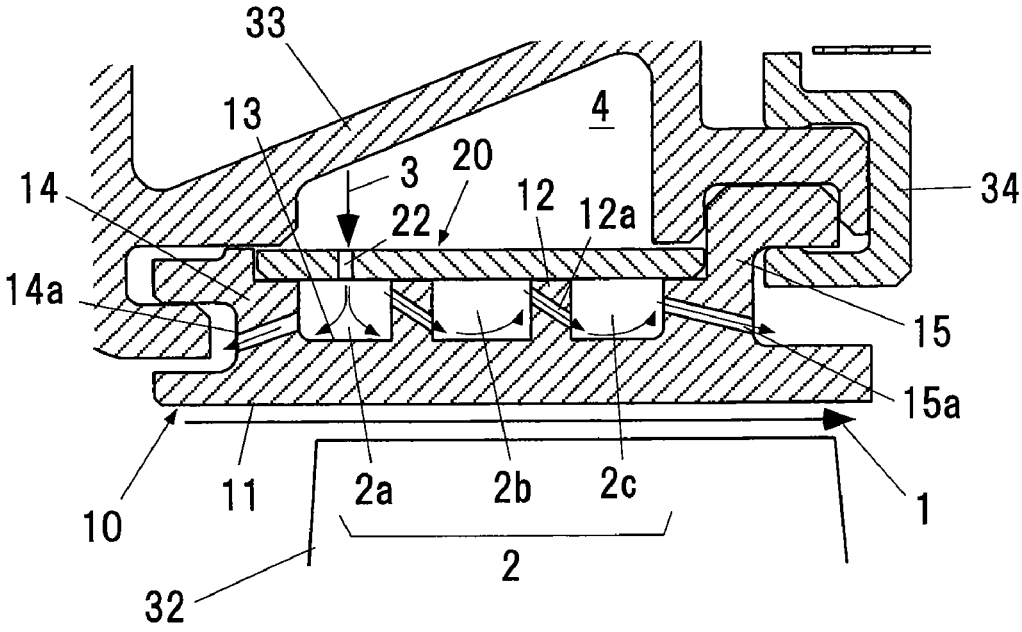
FIG. 6 shows a first embodiment of an impingement cooled structure according to the present invention.

FIG. 6 is a diagram of a first embodiment showing an impingement cooled structure of the present invention.

In FIG. 6, mainstream gas (hot gas stream 1) which flows into a turbine undergoes adiabatic expansion when the mainstream gas performs work to a turbine blade 32. Accordingly, an upstream side of a turbine shroud is higher in temperature than a downstream side of the turbine shroud. Taking it into account, this embodiment is a basic configuration of the present invention for enhancing cooling of the upstream side.

In the drawing, the reference numeral 32 indicates a fast-rotating turbine blade, the reference numeral 33 indicates a fixing portion, such as an inner surface of an engine, which allows a turbine shroud to be fixed thereto, and the reference numeral 34 indicates fixing hardware.

The impingement cooled structure of the present invention is constituted by a plurality of shroud members 10 and a shroud cover 20.

The shroud members 10 are disposed in a circumferential direction to constitute a ring-shaped shroud which surrounds the hot gas stream 1. The shroud cover 20 is mounted on the radial outside faces of the shroud members 10 to constitute a cavity 2 therebetween.

The shroud members 10 each have an inner surface 11, an outer surface 13, an upstream flange 14 and a downstream flange 15. The inner surface 11 extends along the hot gas stream 1 to be directly exposed to the hot gas stream 1. The outer surface 13 is positioned at the outside of the inner surface 11 to constitute a bottom surface of the cavity 2. The upstream flange 14 extends in the radial outward direction from the upstream side of the hot gas stream 1 to be fixed to the fixing portion 33. The downstream flange 15 extends in the radial outward direction from the downstream side of the hot gas stream 1 to be fixed to the fixing portion 33.

The upstream flange 14 and the downstream flange 15 are fixed to the fixing portion 33 to form a cooling air chamber 4 outside the shroud cover 20.

Furthermore, the shroud members 10 each include hole fins 12 at its central portion at a radial outward side. The hole fins 12 divide the cavity 2 into a plurality of sub-cavities 2*a*, 2*b*, and 2*c*. Although two hole fins 12 are used in the embodiment, a single or three or more hole fins 12 may be used. The hole fin means a fin having a second impingement cooling hole 12*a* described later.

The hole fins 12 extend in the radial outward direction from the outer surface 13 which constitutes the bottom surface of the cavity 2 to an inner surface (lower surface in the drawing) of the shroud cover 20 to divide the cavity 2 into a plurality of sub-cavities 2*a*, 2*b*, and 2*c* arranged adjacent to each other along the hot gas stream.

In addition, the hole fins 12 each have a second impingement cooling hole 12*a* which allows cooling air 3 having flowed through a first impingement cooling hole 22 to be jetted obliquely toward the bottom surfaces of the adjacent sub-cavities 2*b* and 2*c*.

The shroud cover 20 has the first impingement cooling hole 22 which communicates with the cavity 2 and allows the cooling air 3 to be jetted to the inside thereof so as to cool the inner surface of the cavity by impingement. The first impingement cooling hole 22 in the embodiment communicates with the sub-cavity 2*a* positioned on the most upstream side along the hot gas stream 1, and is a through hole perpendicular to the hot gas stream 1.

However, the present invention is not limited to this configuration, and the first impingement cooling hole 22 may communicates with the mid sub-cavity 2*b* or the sub-cavity 2*c* on the downstream side.

In the embodiment, the upstream flange 14 and the downstream flange 15 have third impingement cooling holes 14*a* and 15*a*, respectively, which allow the cooling air to be jetted toward the outer surfaces of the respective flanges 14 and 15 from the cavity 2.

In the impingement cooled structure of FIG. 6, the high-pressure cooling air 3 first flows through the first impingement cooling hole 22 and impinges perpendicularly upon a portion of the outer surface 13 (hot wall) which constitutes the bottom surface of the sub-cavity 2*a* to thereby absorb heat from the hot wall. Then, the cooling air 3 reaches a second impingement cooling hole 12*a* on the upstream side while exchanging heat with a hole fin 12, flows through the hole 12*a*, and impinges again upon a hot wall (a portion of the outer surface 13 which constitutes the bottom surface of the sub-cavity 2*b*) to thereby absorb heat from the wall. At the same time, part of the cooling air 3 reaches the third impingement cooling hole 14*a* while exchanging heat with the upstream flange 14, flows through the hole, and impinges upon the outer surface of the flange, and then exits to a mainstream while absorbing heat from the wall.

Furthermore, the cooling air 3 having flowed in the sub-cavity 2*b* reaches a second impingement cooling hole 12*a* on the downstream side while exchanging heat with a hole fin 12, flows through the hole 12*a*, and impinges again upon a hot wall (a portion of the outer surface 13 which constitutes the bottom surface of the sub-cavity 2*c*) to thereby absorb heat from the wall. Finally, the cooling air 3 reaches the third impingement cooling hole 15*a* while exchanging heat with the downstream flange 15, flows through the hole 15*a*, and impinges upon the outer surface of the flange to thereby absorb heat from the wall, and then exit to the mainstream.

According to the aforementioned configuration, in the impingement cooled structure of the present invention, the cooling performance is improved by the effects obtained by the hole fins as well as re-use of cooling air. Accordingly, in the cooled structure of the present invention, even if the used amount of cooling air is reduced to about ½ or less than the used amount of cooling air in conventional impingement cooling, it is possible to maintain a metal temperature equivalent to that in conventional impingement cooling.

Figure 7:
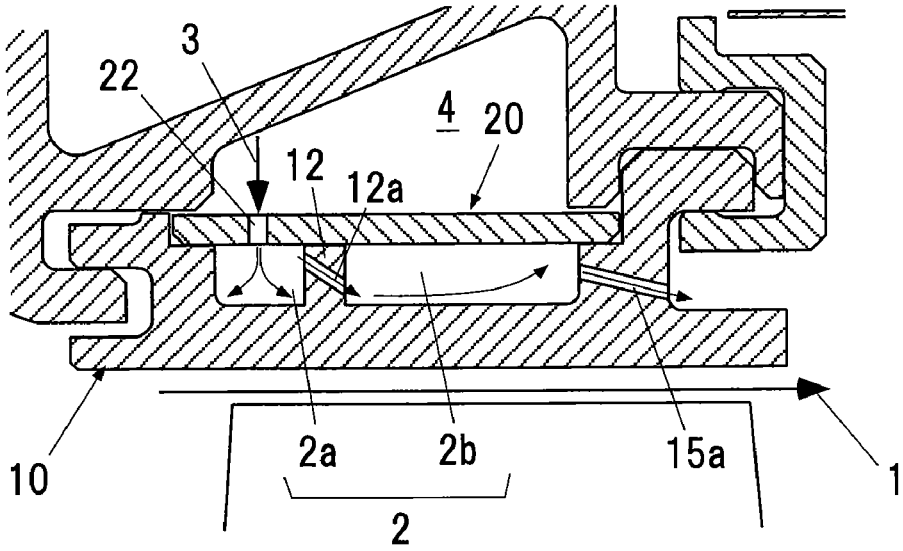
FIG. 7 is a cross-sectional view showing a second embodiment of the structure according to the present invention.

FIG. 7 is a cross-sectional view showing a second embodiment of the structure of the present invention. In the second embodiment, compared with the first embodiment (basic configuration), a single hole fin 12 is used, a third impingement cooling hole 14*a* is not formed in the upstream flange 14, and only a third impingement cooling hole 15*a* is formed in a downstream flange 15. The other configuration of the second embodiment may be the same as that of the first embodiment (basic configuration).

By the configuration of the second embodiment, the number of stages of impingement cooling can be reduced. Alternatively, in contrast, the number of stages of impingement cooling may be increased by increasing the number of hole fins 12.

Figure 8:
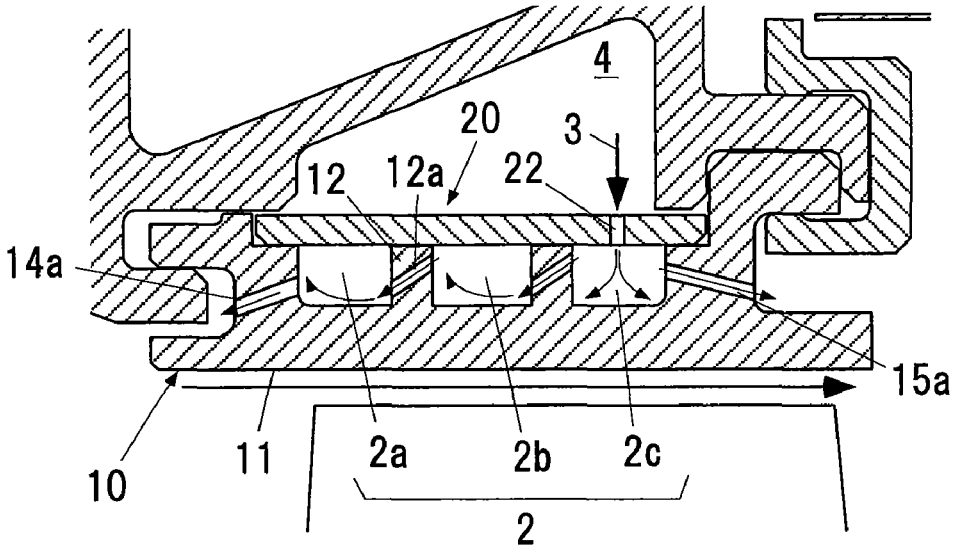
FIG. 8 is a cross-sectional view showing a third embodiment of the structure according to the present invention.
Figure 9:
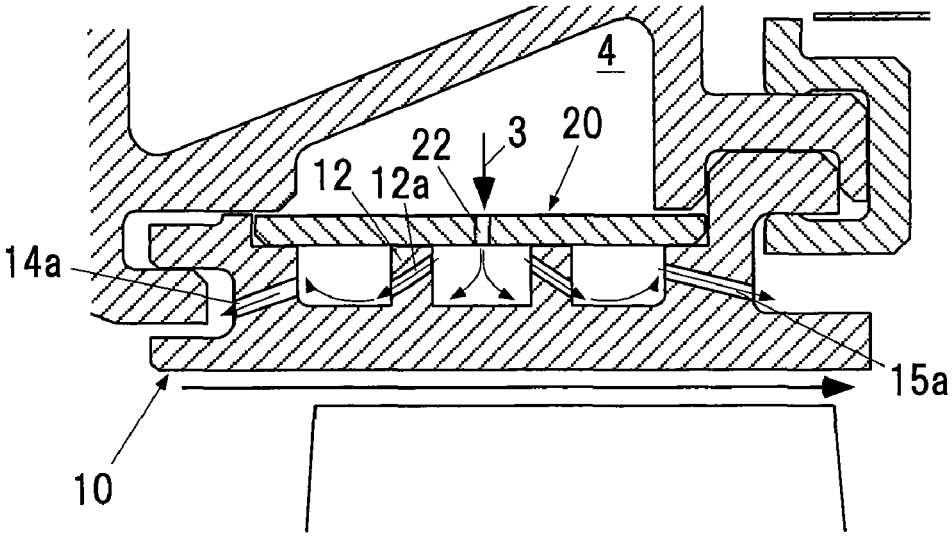
FIG. 9 is a cross-sectional view showing a fourth embodiment of the structure according to the present invention.

FIGS. 8 and 9 are cross-sectional views showing third and fourth embodiments, respectively, of the structure of the present invention. In the third and fourth embodiments, compared with the first embodiment (basic configuration), a location where impingement cooling by cooling air is first performed is changed.

Figure 10:
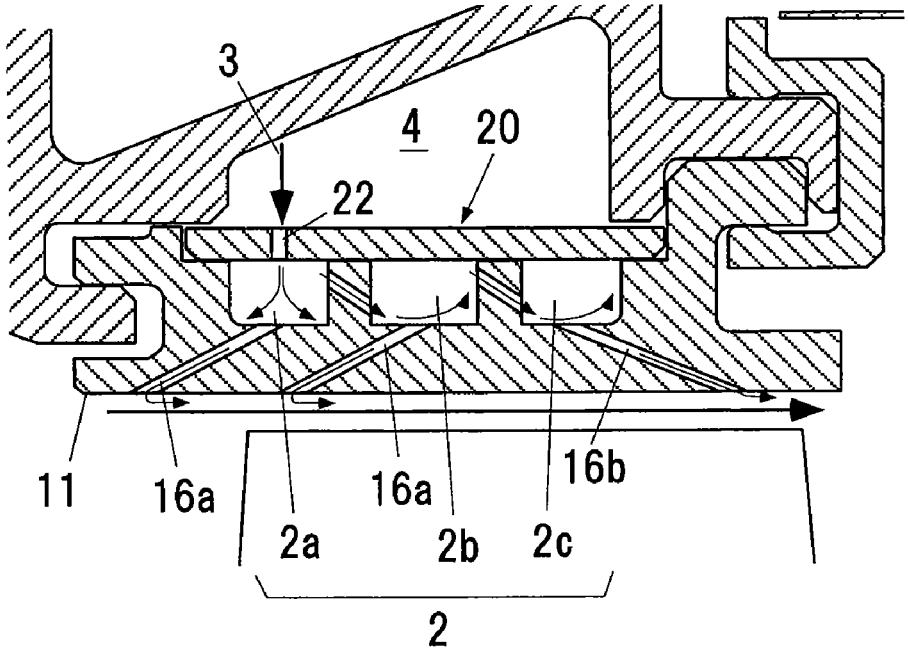
FIG. 10 is a cross-sectional view showing a fifth embodiment of the structure according to the present invention.

FIG. 10 is a cross-sectional view showing a embodiment of the structure of the present invention. In the fifth embodiment, compared with the first embodiment (basic configuration), a third impingement cooling hole 14*a* and a third impingement cooling hole 15*a* are omitted. Instead, shroud members 10 each have film cooling holes 16*a* and 16*b* which allow cooling air 3 to be jetted obliquely toward an inner surface 11 from cavity 2 (sub-cavities 2*a*, 2*b*, and 2*c*).

By this configuration of the fifth embodiment, cooling can be enhanced by the film cooling holes in accordance with design requirements, for example.

Figure 11:
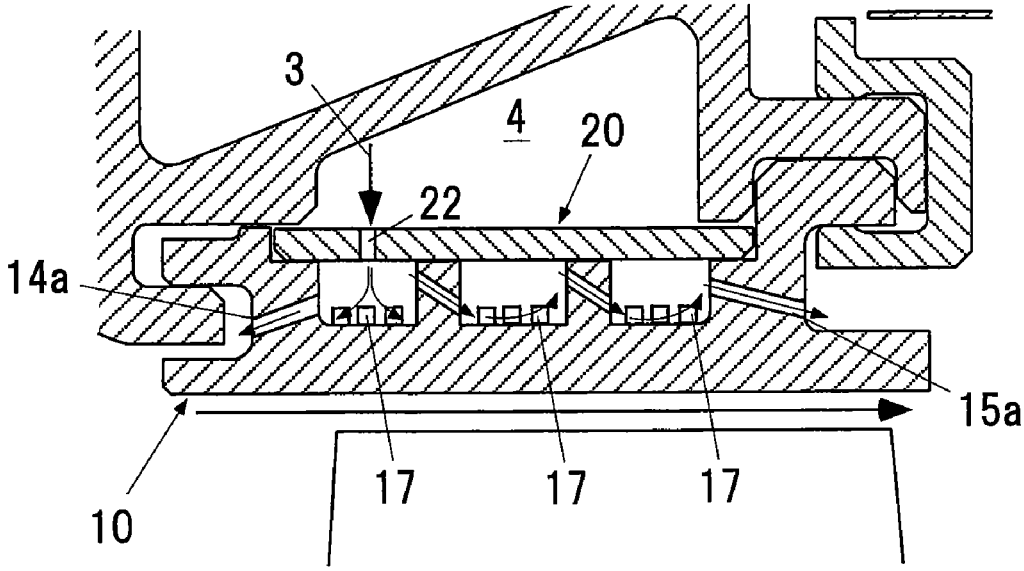
FIG. 11 is a cross-sectional view showing a sixth embodiment of the structure according to the present invention.

FIG. 11 is a cross-sectional view showing a sixth embodiment of the structure of the present invention. In the sixth embodiment, compared with the first embodiment (basic configuration), turbulence promoters 17 are provided on the bottom surface of the cavity 2 (sub-cavities 2*a*, 2*b*, and 2*c*). The turbulence promoters 17 are preferably pins, projections, or the like, which have a function of increasing the heat transfer coefficient by interrupting a flow. Other than the turbulence promoters, for the purpose of increasing a heat transfer area, larger projections, pins, or the like may be provided.

By this configuration of the sixth embodiment, it is possible to enhance cooling by increasing the heat transfer coefficient and the heat transfer area.

Figure 12:
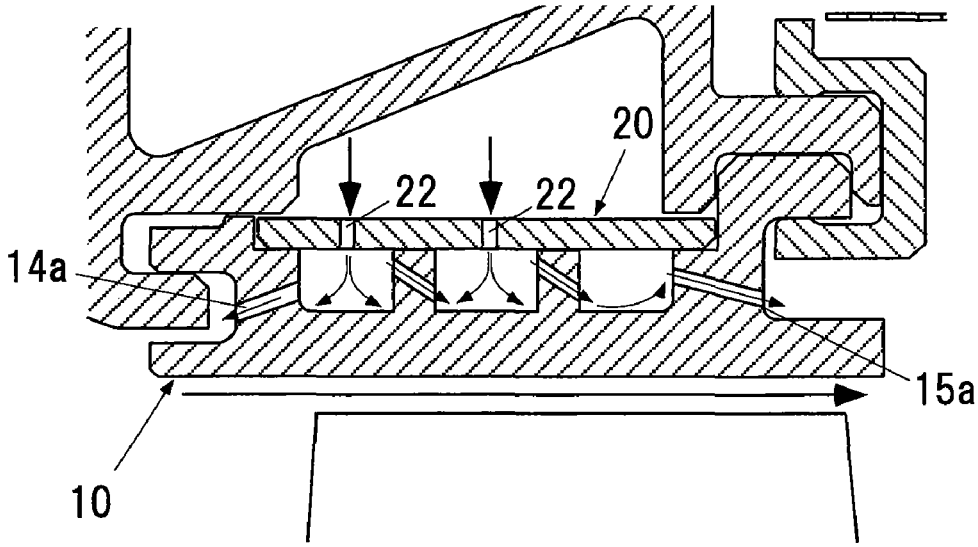
FIG. 12 is a cross-sectional view showing a seventh embodiment of the structure according to the present invention.

FIG. 12 is a cross-sectional view showing a seventh embodiment of the structure of the present invention. In the seventh embodiment, compared with the first embodiment (basic configuration), vertical impingement cooling holes (first impingement cooling holes 22) are additionally provided to locally cool a location where the metal temperature increases.

Figure 13:
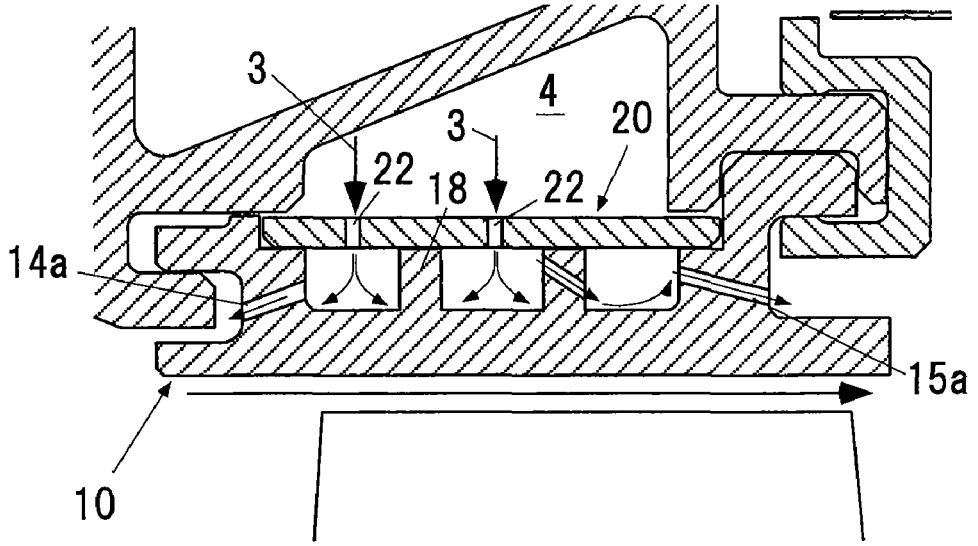
FIG. 13 is a cross-sectional view showing an eighth embodiment of the structure according to the present invention.

FIG. 13 is a cross-sectional view showing an eighth embodiment of the structure of the present invention. In the eighth embodiment, compared with the first embodiment (basic configuration), shroud members 10 each have a non-hole fin 18 which divides a cavity 2 into a plurality of sub-cavities. By the non-hole fin 18, the flow path of cooling air 3 is divided into two flow paths. The non-hole fin means a fin which does not have the second impingement cooling hole 12*a*.

By this configuration of the eighth embodiment, although the amount of cooling air is increased, cooling can be further enhanced.

First Example

Test results obtained by comparing the cooling efficiency of the aforementioned structure of the present invention against that of conventional examples are described below.

Figure 14A:
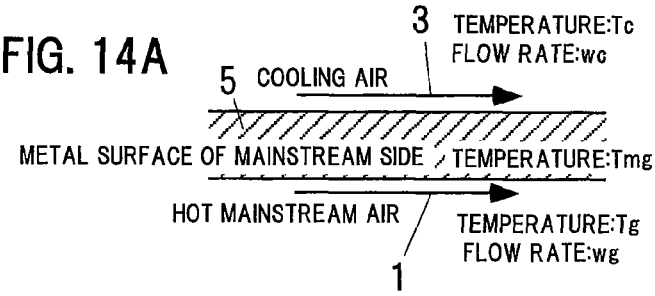
FIG. 14A is a schematic illustration for description of cooling efficiency.

As schematically shown in FIG. 14A, a test piece 5 which simulates a turbine shroud is produced. In a state in which hot gas 1 is flowed over one surface and cooling air 3 is flowed over the other surface, a metal surface temperature Tmg of the mainstream side of the test piece 5 is measured, and cooling efficiency $\eta$ is calculated.

The cooling efficiency $\eta$ is defined by the formula of $\eta=(Tg-Tmg)/(Tg-Tc)$ . . . (1), where Tg is the hot mainstream air temperature and Tc is the cooling air temperature.

Figure 14B:
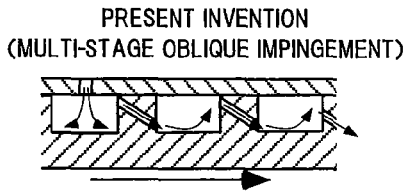
FIG. 14B schematically shows the structure of the present invention.
Figure 14C:
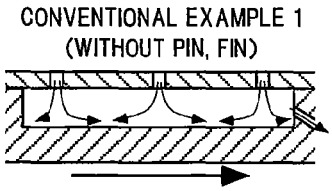
FIG. 14C schematically shows the structure of a conventional example.
Figure 14D:
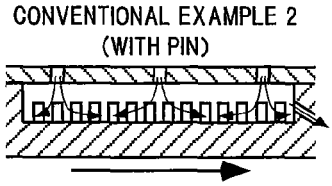
FIG. 14D schematically shows the structure of another conventional example.

FIG. 14B shows a structure (multiple-stage oblique impingement) of the present invention used in the test, FIG. 14C shows a conventional example 1 (no pin, fin), and FIG. 14D shows a conventional example 2 (with pins). Other conditions are the same for all structures.

Figure 15:
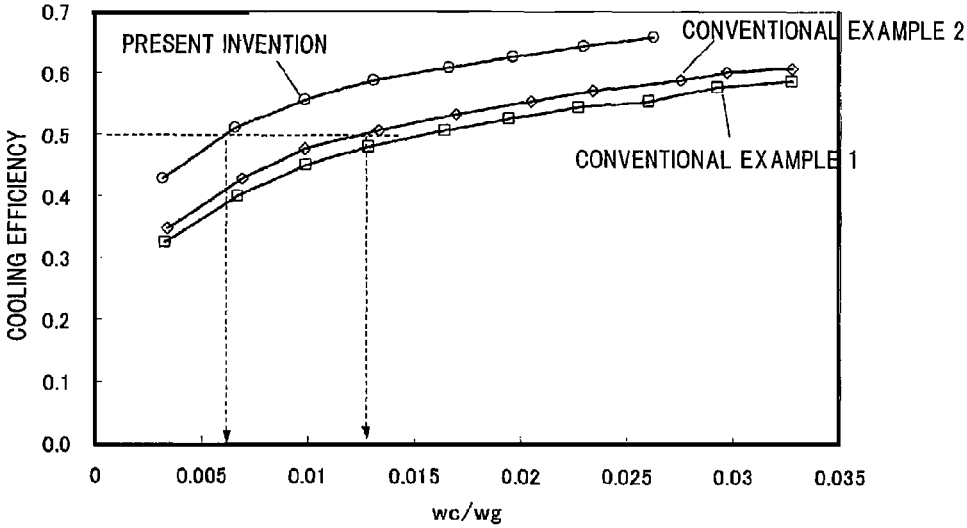
FIG. 15 is a graph showing test results which show a relationship between a ratio (wc/wg) of a cooling air flow rate wc to a hot mainstream air flow rate wg and a cooling efficiency η.

FIG. 15 shows test results. The horizontal axis represents the ratio (wc/wg) of a cooling air flow rate wc to a hot mainstream air flow rate wg, and the vertical axis represents the cooling efficiency $\eta$.

From the graph, it can be seen that the cooling efficiency of the present invention is high compared with the conventional examples 1 and 2. For example, when a cooling efficiency of 0.5 is required, wc/wg in the present invention is about 0.6% while wc/wg in the conventional examples is about 1.3%. Thus, the amount of air required can be reduced to ½ or less with the cooling efficiency $\eta$ being maintained.

Second Example

Next, in the structure of the present invention, the influence of a gap at a fin tip is tested.

Figure 16:
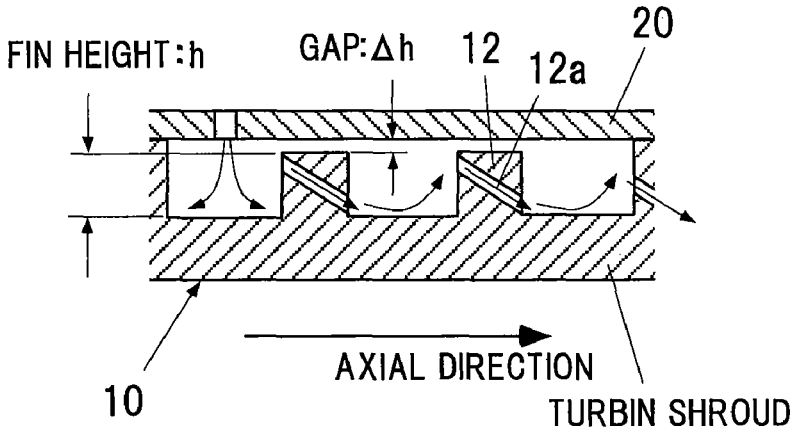
FIG. 16 is an illustrative diagram showing a relationship between a gap Δh at a fin tip and a height h of a hole fin.

FIG. 16 is an illustrative diagram showing a relationship between a gap $\Delta h$ between a radial outward end of a hole fin 12 and an inner surface of a shroud cover 20, and a height h of the hole fin. In the drawing, the value ($\Delta h/h$) obtained by dividing the gap $\Delta h$ between the fin tip and the plate by the fin height h is set to range from 0 (no gap) to 0.2, and a calculation of a cooling air flow rate and a heat transfer analysis are performed.

Figure 17:
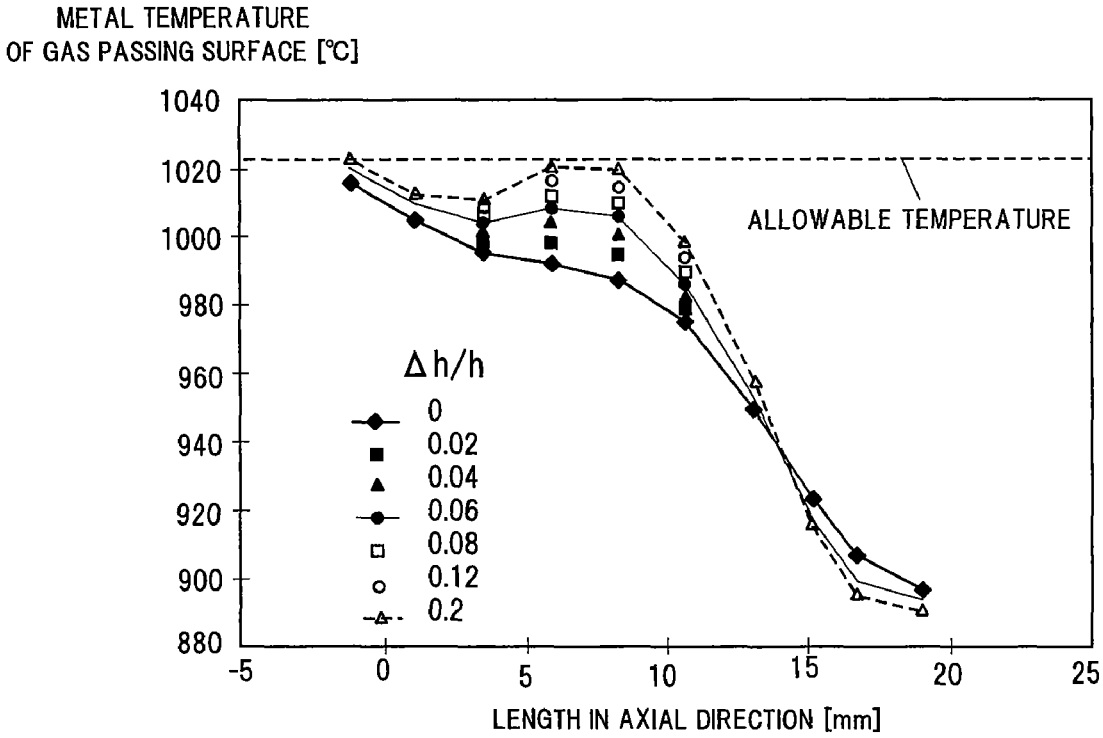
FIG. 17 is a graph showing analysis results which show a relationship between an axial length and a metal temperature of a gas passing surface (metal surface temperature on a mainstream side)

FIG. 17 shows the analysis results. The horizontal axis represents the axial length and the vertical axis represents the metal temperature of a gas passing surface (metal surface temperature on the mainstream side). Lines in the drawing represent results for $\Delta h/h$ ranging from 0 to 0.2.

From the graph, it is found that the temperature of the turbine shroud stands below an allowable value when $\Delta h/h$ stands at or below about 0.2.

Third Example

Next, in the structure of the present invention, the influence of the angle of a second impingement cooling hole 12*a* is tested.

Figure 18:
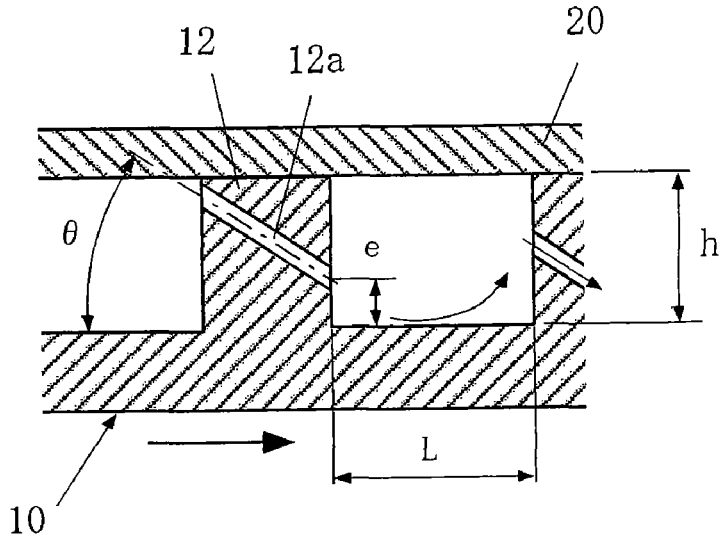
FIG. 18 is an illustrative diagram showing a relationship between an angle θ of a second impingement cooling hole and a height h of a hole fin.

FIG. 18 is an illustrative diagram showing a relationship between the angle $\theta$ of the second impingement cooling hole 12*a* and the height e of an impingement. In the drawing, a cooling performance test is conducted under the following conditions: the angle $\theta$=30° and 45°, and h/L=0.13 and 0.26, where h is the height of an impingement, and L is cooling chamber length.

Figure 19:
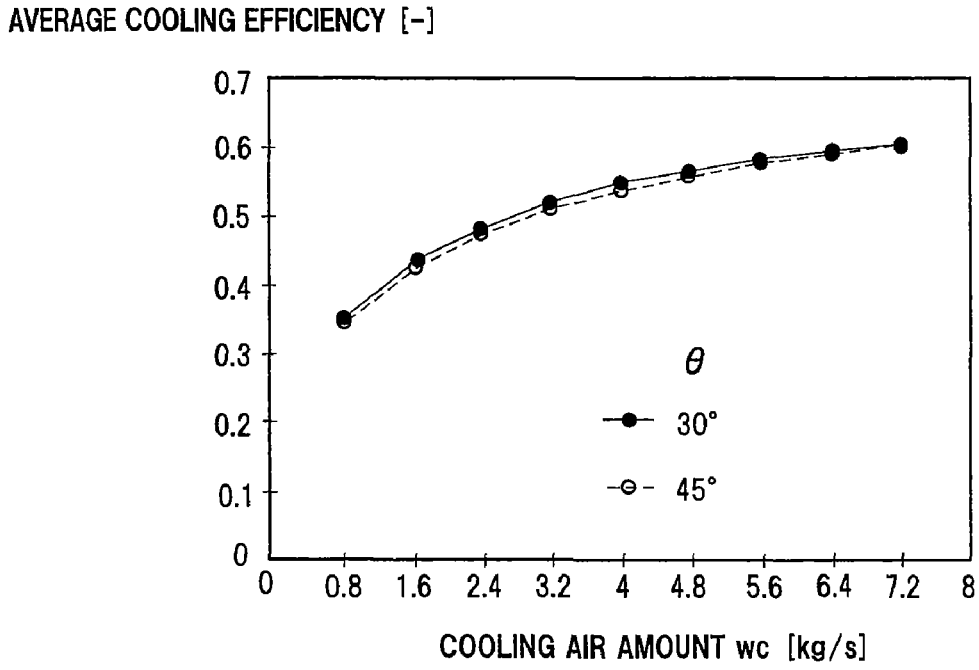
FIG. 19 is a graph showing test results which show a relationship between a cooling air flow rate and average cooling efficiency, with the angle θ being 30° and 45°.

FIG. 19 shows the test results. The horizontal axis represents the cooling air flow rate, and the vertical axis represents the average cooling efficiency. Solid circles and open circles in the graph represent the test results for 30° and 45°, respectively.

From the graph, it is found that even if the angle is changed, the cooling efficiency is not much affected thereby.

Fourth Example

Next, under the same conditions as those in FIG. 18, the influence of an impingement height e is tested.

Figure 20A:
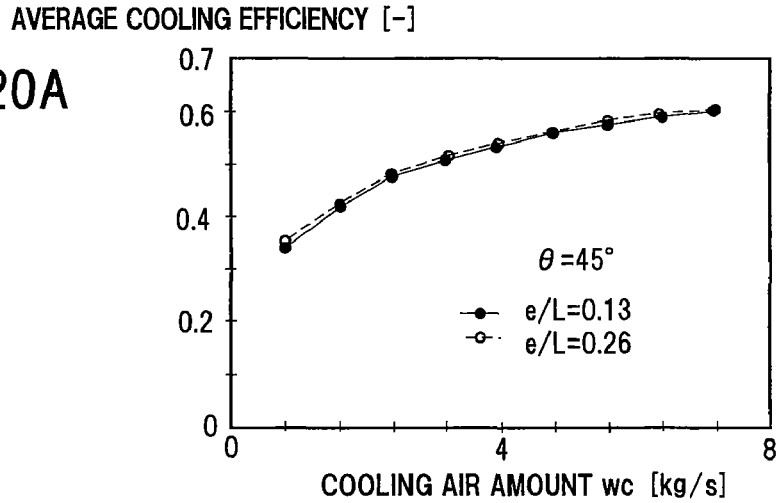
FIG. 20A is a graph showing test results which show a relationship between a cooling air flow rate and average cooling efficiency, with the angle θ being 45°, with e/L being 0.13 and 0.26.
Figure 20B:
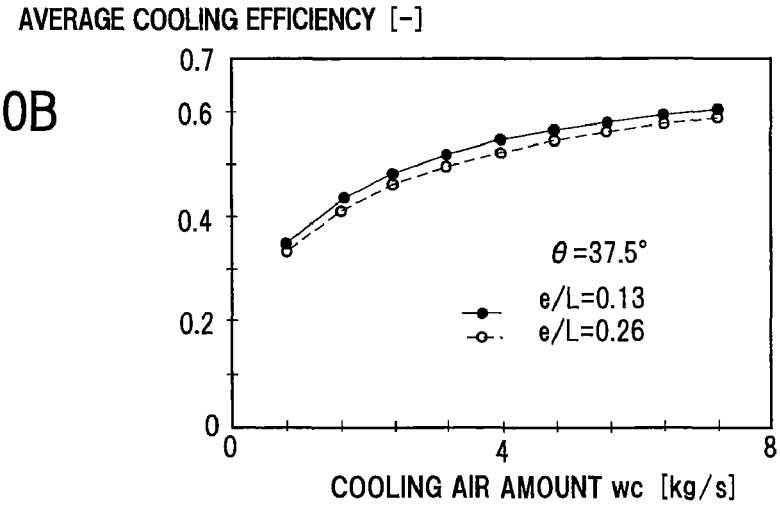
FIG. 20B is a graph showing test results which show a relationship between a cooling air flow rate and average cooling efficiency, with the angle θ being 37.5°, with e/L being 0.13 and 0.26.
Figure 20C:
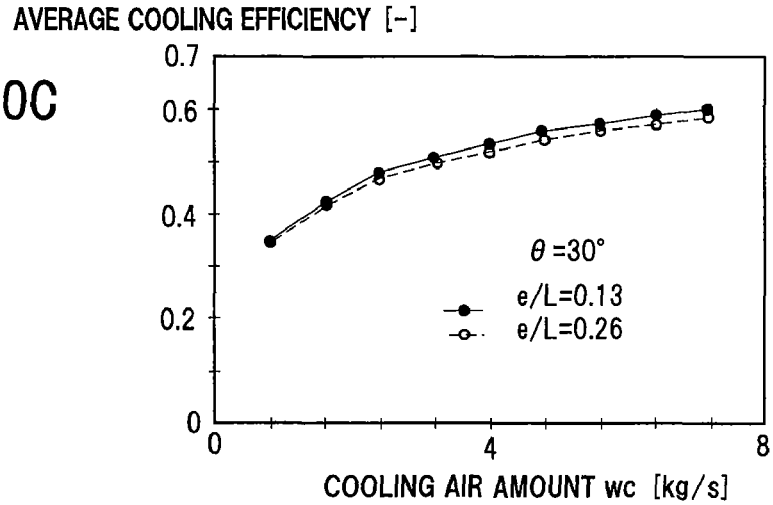
FIG. 20C is a graph showing test results which show a relationship between a cooling air flow rate and average cooling efficiency, with the angle θ being 30°, with e/L being 0.13 and 0.26.

FIGS. 20A, 20B, and 20C show the test results. The horizontal axis represents the cooling air flow rate and the vertical axis represents the average cooling efficiency. Solid circles and open circles in each graph represent the test results for the value of e/L being 0.13 and 0.26, respectively.

From the graphs, it can be seen that, when the value of e/L (where e is the impingement height, and L is cooling chamber length) is changed, the cooling efficiency when e/L is 0.13 is higher. However, when the angel $\theta$ of the second impingement cooling hole 12*a* is made large, the shroud thickness needs to be increased, resulting in undesirable effects such as an increase in weight and an increase in thermal stress at the time of operation. Therefore, the angle $\theta$ preferably stands at or below about 45°. In addition, the value of e/L is preferably small, preferably 0.26 or less.

As described above, according to the configuration of the present invention, the shroud cover 20 has the first impingement cooling hole 22 which allows cooling air 3 to be jetted in a cavity 2 formed between the shroud cover 20 and the shroud members 10, to cool the inner surface of the cavity by impingement, the shroud members 10 each have the hole fin 12 which divides the cavity 2 into a plurality of sub-cavities, and the hole fin 12 has a second impingement cooling hole 12*a* which allows the cooling air 3 having flowed through the first impingement cooling hole 22 to be jetted obliquely toward the bottom surface of the adjacent sub-cavity.

Therefore, it is possible to reduce the amount of cooling air for cooling hot walls of a turbine shroud and a turbine end wall, with the thickness of the shroud members 10 being the same as that of conventional ones, without increasing radial thickness of the entire shroud, by the structure simply having the hole fins 12 that is as simple as a conventional structure.

The present invention is not limited to the aforementioned examples and embodiments. Needless to say, various modifications of the aforementioned examples and embodiments may be made without departing from the scope of the invention.

What is claimed is:

1. An impingement cooled structure comprising:

(a) a plurality of shroud members disposed in a circumferential direction to constitute a ring-shaped shroud surrounding a hot gas stream; and (b) a shroud cover mounted on radial outside faces of the plurality of shroud members to form a cavity therebetween, wherein the shroud cover has a first impingement cooling hole formed therein that communicates with the cavity and allows cooling air to be jetted toward a bottom surface of the cavity so as to cool the bottom surface of the cavity by impingement, wherein each shroud member of the plurality of shroud members has a hole fin, wherein the hole fin extends in a radial outward direction from the bottom surface of the cavity toward an inner surface of the shroud cover, and the hole fin divides the cavity in the hot gas stream into a first plurality of sub-cavities, and the hole fin has a second impingement cooling hole formed obliquely relative to a bottom surface of a first sub-cavity so that the second impingement cooling hole allows the cooling air having flowed through the first impingement cooling hole to be jetted obliquely toward the bottom surface of the first sub-cavity adjacent thereto.

2. An impingement cooled structure according to claim 1, wherein each shroud member of the plurality of shroud members comprises:

i. an inner surface extending along the hot gas stream to be directly exposed to the hot gas stream;

ii. an outer surface positioned at an outside of the inner surface to constitute a portion of the bottom surface of the cavity;

iii. an upstream flange extending in a radial outward direction from an upstream side of the hot gas stream so as to be fixed to a fixing portion; and iv. a downstream flange extending in a radial outward direction from a downstream side of the hot gas stream so as to be fixed to the fixing portion, wherein the upstream flange and the downstream flange are disposed to provide a cooling air chamber outside the shroud cover, and wherein the hole fin extends in the radial outward direction towards the inner surface of the shroud cover from the outer surface constituting the bottom surface of the cavity in order to divide the cavity into the first plurality of sub-cavities adjacent to each other along the hot gas stream.

3. An impingement cooled structure according to claim 2, wherein the upstream flange, or the downstream flange, or the upstream flange and the downstream flange, has a third impingement cooling hole formed therein that allows the cooling air to be jetted toward an outer surface thereof from the cavity.

4. An impingement cooled structure according to claim 2, wherein each shroud member of the plurality of shroud members has a film cooling hole formed therein that allows the cooling air to be jetted toward an inner surface of the shroud member from the cavity.

5. An impingement cooled structure according to claim 1, further comprising:

(c) a turbulence promoter disposed on the bottom surface of the cavity; and (d) a projection or a pin disposed on the bottom surface of the cavity, wherein the turbulence promoter promotes turbulence, and the projection or the pin increases a heat transfer area.

6. An impingement cooled structure according to claim 1, wherein each shroud member of the plurality of shroud members has a non-hole fin that divides the cavity into a second plurality of sub-cavities and divides a first flow path of the cooling air into two or more second flow paths.

7. An impingement cooled structure comprising:

(a) a plurality of shroud members disposed in a circumferential direction to constitute a ring-shaped shroud surrounding a hot gas stream; and (b) a shroud cover mounted on radial outside faces of the plurality of shroud members to form a cavity therebetween, wherein the shroud cover has a first impingement cooling hole formed therein that communicates with the cavity and allows cooling air to be jetted toward a bottom surface of the cavity so as to cool the bottom surface of the cavity by impingement, wherein each shroud member of the plurality of shroud members has a hole fin, wherein the hole fin extends in a radial outward direction from the bottom surface of the cavity toward an inner surface of the shroud cover, and the hole fin divides the cavity in the hot gas stream into a first plurality of sub-cavities, and the hole fin has a second impingement cooling hole formed obliquely relative to a bottom surface of a first sub-cavity so that the second impingement cooling hole allows the cooling air having flowed through the first impingement cooling hole to be jetted obliquely toward the bottom surface of the first sub-cavity adjacent thereto, wherein each shroud member of the plurality of shroud members comprises i. an inner surface extending along the hot gas stream to be directly exposed to the hot gas stream;

ii. an outer surface positioned at an outside of the inner surface to constitute a portion of the bottom surface of the cavity;

iii. an upstream flange extending in a radial outward direction from an upstream side of the hot gas stream so as to be fixed to a fixing portion; and iv. a downstream flange extending in a radial outward direction from a downstream side of the hot gas stream so as to be fixed to the fixing portion, wherein the upstream flange and the downstream flange are disposed to provide a cooling air chamber outside the shroud cover, wherein the hole fin extends in the radial outward direction towards the inner surface of the shroud cover from the outer surface constituting the bottom surface of the cavity in order to divide the cavity into the first plurality of sub-cavities adjacent to each other along the hot gas stream, and wherein a gap is formed between a radial outward end of the hole fin and the inner surface of the shroud cover, wherein a height $\Delta h$ of the gap is 0.2 or less times as high as a height h of the hole fin.

8. An impingement cooled structure comprising:

(a) a plurality of shroud members disposed in a circumferential direction to constitute a ring-shaped shroud surrounding a hot gas stream; and (b) a shroud cover mounted on radial outside faces of the plurality of shroud members to form a cavity therebetween, wherein the shroud cover has a first impingement cooling hole formed therein that communicates with the cavity and allows cooling air to be jetted toward a bottom surface of the cavity so as to cool the bottom surface of the cavity by impingement, wherein each shroud member of the plurality of shroud members has a hole fin, wherein the hole fin extends in a radial outward direction from the bottom surface of the cavity toward an inner surface of the shroud cover, and the hole fin divides the cavity in the hot gas stream into a first plurality of sub-cavities, and the hole fin has a second impingement cooling hole formed obliquely relative to a bottom surface of a first sub-cavity so that the second impingement cooling hole allows the cooling air having flowed through the first impingement cooling hole to be jetted obliquely toward the bottom surface of the first sub-cavity adjacent thereto, wherein each shroud member of the plurality of shroud members comprises i. an inner surface extending along the hot gas stream to be directly exposed to the hot gas stream;

ii. an outer surface positioned at an outside of the inner surface to constitute a portion of the bottom surface of the cavity;

iii. an upstream flange extending in a radial outward direction from an upstream side of the hot gas stream so as to be fixed to a fixing portion; and iv. a downstream flange extending in a radial outward direction from a downstream side of the hot gas stream so as to be fixed to the fixing portion, wherein the upstream flange and the downstream flange are disposed to provide a cooling air chamber outside the shroud cover, wherein the hole fin extends in the radial outward direction towards the inner surface of the shroud cover from the outer surface constituting the bottom surface of the cavity in order to divide the cavity into the first plurality of sub-cavities adjacent to each other along the hot gas stream, and wherein an angle of the second impingement cooling hole to a bottom surface of the first sub-cavity is 45° or less, and an impingement height e is 0.26 or less times as long as a length L of the first sub-cavity in a flow path direction.

* * * * *